United States Patent [19]

Ibrahim et al.

[11] 4,367,632

[45] Jan. 11, 1983

[54] FLEXIBLE DOOR OPERATING MECHANISM FOR REFRIGERATED MERCHANDIZER DISPLAY CABINET

[75] Inventors: Fayez F. Ibrahim, Niles; Elmer J. Subera, Cassopolis; James E. Myers, Niles, all of Mich.

[73] Assignee: Tyler Refrigeration Corporation, Niles, Mich.

[21] Appl. No.: 261,872

[22] Filed: May 8, 1981

[51] Int. Cl.[3] ..... F25D 21/12

[52] U.S. Cl. ..... 62/82; 62/282; 62/256

[58] Field of Search ..... 62/82, 282, 255, 256, 62/411

[56] References Cited

U.S. PATENT DOCUMENTS

| | | | |
|---|---|---|---|
| 3,226,945 | 1/1966 | Spencer | 62/256 |
| 3,369,375 | 2/1968 | Gerweck et al. | 62/411 X |
| 3,371,503 | 3/1968 | Perez | 62/256 |
| 3,850,003 | 11/1974 | Beckwith et al. | 62/256 X |
| 3,937,033 | 2/1976 | Beckwith et al. | 62/256 X |
| 4,026,121 | 5/1977 | Aokage et al. | 62/151 |
| 4,072,488 | 2/1978 | Johnston | 62/282 |
| 4,120,174 | 10/1978 | Johnston | 62/256 |
| 4,144,720 | 3/1979 | Subera et al. | 62/256 |
| 4,182,130 | 1/1980 | Ljung | 62/256 X |
| 4,207,747 | 6/1980 | Subera et al. | 62/82 |

*Primary Examiner*—Lloyd L. King

*Attorney, Agent, or Firm*—LeBlanc, Nolan, Shur & Nies

[57] ABSTRACT

A door operating mechanism for use with refrigerated display cases in which provision is made for one or more circulated air bands and an air defrost means. The door operating mechanism functions to selectively create a gap between the barrier door and the associated access opening of the case to carry out defrosting and to also permit the gap to be closed by the application of outside force. A motion take-up means is provided within the door operating mechanism to permit closing of a door through the operation of a flexing means which is preferably a compression spring. Temporary closing of the door gap by customers and employees is operatively provided for by the door operating mechanism.

25 Claims, 9 Drawing Figures

FLEXIBLE DOOR OPERATING MECHANISM FOR REFRIGERATED MERCHANDIZER DISPLAY CABINET

BACKGROUND OF THE INVENTION

The present invention relates to "reach-in" merchandiser type of refrigerated display cases or cabinets used primarily in retail food and supermarket outlets and more specifically to a door opening mechanism for such cases. The term "refrigerated", in accordance with the present invention, is intended to incorporate those cases maintained at a temperature at or in excess of 32° F., such as display cases utilized for the display of milk and fresh foods, and those cases maintained below 32° F., such as frozen food cases. In addition, references are made herein to the use of transparent doors, since those types of doors are the most frequently utilized in such retail outlets. Other types of doors could also be employed within the scope of the present invention.

In the operation of all types of refrigerated display cabinets, it is desirable to include a system for automatically defrosting the refrigeration coils. The defrost cycle can be actuated either at set periodic time intervals or when the frost buildup within the system has reached a certain predetermined level. Such systems are typically thermostatically controlled so as to switch from a refrigeration cycle to a defrost cycle of operation. In this manner of operation, it is possible to avoid any significant frost buildup within the display cabinet such that inoperability and spoilage of food products would occur.

There have been three different approaches for defrosting refrigerated display cabinets in this art. These are, utilizing electric resistance heaters; passing a compressed refrigerant gas having a high specific heat through the refrigeration coils; and, circulating ambient air through an air conduit in which the refrigeration coils are positioned. Due to the increased cost of energy, efforts have been made to place more emphasis on the utilization of ambient air defrost systems as an alternative to the electrical resistance heaters or compressed refrigerant gas defrost systems.

This invention relates to a "reach-in" transparent door merchandiser type of refrigerated display cabinet having an air defrost system incorporated therein. It also relates to the disclosures made in applications Ser. No. 101,069, filed Dec. 7, 1979, now U.S. Pat. No. 4,265,090; Ser. No. 141,359 and Ser. No. 141,360 both filed Apr. 18, 1980; and Ser. No. 145,711, filed May 1, 1980, now U.S. Pat. No. 4,341,083 all of which have a common assignee with the present application. The disclosures of all of these applications are hereby incorporated by reference as though fully set forth herein.

One type of system which employs ambient air during a defrost cycle is exemplified by U.S. Pat. Nos. 3,403,525; 3,850,003 and 3,937,033, all to Beckwith et al. These systems use fans separate and distinct from the main circulating fans to move ambient air across the refrigeration coils for defrosting. The additional fans are turned on only during the defrost cycle of operation for pulling ambient air from outside of the display cabinet directly into the air conduits located within the walls of the cabinet. A second type of system is illustrated in U.S. Pat. No. 3,082,612 to Beckwith, which system draws ambient air into the main circulation path through ports located in the lower front panel of the refrigerated display cabinet. Such ports are normally closed during the refrigeration cycle and opened during the defrost cycle. The Beckwith et al U.S. Pat. No. 3,850,003 patent indicates that the concepts described in U.S. Pat. Nos. 3,082,612 and 3,403,525 did not prove to be practical and hence were not commercially feasible.

Another type of ambient air defrost system is shown in U.S. Pat. No. 4,144,720 issued to Subera, et al which is assigned to the same assignee as the present application. In the Subera patent, an open-front refrigerated display case having primary and secondary air conduits is disclosed. In this system, the direction of the air flow within one of the conduits is reversed, for example, by the use of reversible fans to provide ambient air defrost. U.S. Pat. No. 4,026,121 to Aokage, et al, which illustrates an open-front display case, and U.S. Pat. No. 4,120,174 to Johnston, which illustrates an open-top display case, disclose other forms of reverse ambient air flow for defrosting.

In those ambient air defrost systems disclosed in the above-noted patents which use reverse air flow, during the defrost cycle of operation, ambient air can easily be drawn through the access opening of the case or cabinet into the air conduit through the outlet opening of the air conduit and then expelled from the air conduit after the defrost operation through the inlet opening and then forced out of the cabinet through the unblocked access opening. Such an arrangement, however, cannot be readily used in a refrigerated merchandiser display case having barrier doors, since the front opening in the cabinet is covered by the doors. Thus, in order to employ an ambient air defrost system, a different type of system had to be conceived.

In seeking to employ ambient air defrost techniques in cases having doors, systems have been developed for drawing air over a limited portion of the air conduit by opening flaps into the conduit, which flaps are arranged so as to straddle the evaporator coils of the refrigeration mechanism. Such systems are disclosed in U.S. Pat. No. 3,226,945 to Spencer and U.S. Pat. No. 4,072,488 to Johnston. The patent to Spencer illustrates a plurality of different embodiments of open-top refrigerated display cases, both of the single shelf and multi-shelf types, in which the air flow is always drawn over evaporator coils in a single direction under negative pressure. During the refrigeration cycle of operation, air after being refrigerated is circulated through the air conduit and into the display section of the case. The patent to Johnston discloses a glass door type merchandiser display cabinet in which air is circulated through the air conduit in such a direction that cold air enters the display space at the bottom of the cabinet and is then drawn up into the air inlet located near the top of the cabinet. For defrosting, top flaps are opened since this case is designed with coils at the top. This shows a somewhat complicated way to provide both glass doors and air defrost features according to the prior art. Such systems are relatively complex and can involve certain optional problems, particularly due to frost and dust accumulation. Where there are moving parts inside of the air conduit an accumulation of frost on such parts can cause them to stick and hence not function properly.

The prior art as represented by the patents discussed above has treated the opening of the barrier doors on such merchandiser refrigerated cabinets as being only a problem as illustrated by Johnston, U.S. Pat. No. 4,072,488 which describes the frost buildup due to the opening of the cabinet doors.

The prior art does not appear to have viewed the opening of the doors as a possible solution to the problem of supplying the defrosting requirements.

The background of the invention described and claimed in the present application also includes a recognition of the energy conservation demands made by managers of retail food outlets to reduce operating costs wherever possible. One such area of energy conservation is to provide heat transfer constraining barrier doors across the refrigerated merchandiser display cabinets. Such barrier doors are often constructed of double or triple layer glass or other transparent materials in order to reduce the contact between the ambient air which has high heat and moisture content and the refrigerated air within the display cabinet.

During periods of high door openings frequency for shopping or stocking the case or when the store ambient heat and humidity levels are elevated the refrigerated air band which may be at a temperature as low as −15° F. is contacted by ambient air having a temperature as high as 75° F. This contact can raise the refrigeration load even above that required by multi-air band open front cases having no barrier doors. To solve this problem, it is optimum to employ one or two guard air bands which can protect the inner refrigerated band against direct contact with the ambient air when the merchandiser doors are opened.

Beckwith et al U.S. Pat. No. 3,403,525 also discloses a night curtain which is to be placed over the normally open access area of a refrigerated case in order to reduce energy consumption during the "non-sales" hours, but with this arrangement no air defrost or customer entry is possible.

Vogel, U.S. Pat. No. 4,117,698, discloses a retractable night curtain for use during closed store hours during which no provision is made for customer entry.

SUMMARY OF THE INVENTION

An improvement in refrigerated cases is provided in which provision is made for one or more circulated air bands, an air defrost means, and a door operating mechanism which functions to selectively create a gap between a barrier door and the associated access opening to effect defrosting in a simple and low energy consumption manner. The door operating mechanism also permits the gap to be closed by the application of outside force since customers and store personnel have a tendency to close the partially opened door. A motion take-up means containing a flexing means is provided to effect this function. The preferred flexing means is a compression spring.

The air defrost means also includes an air moving means for passing ambient air through the cabinet and through the gap held between the door and the access opening to bring the ambient air into contact with refrigeration elements in the cabinet to remove accumulated frost therefrom and to thereafter eject the defrost ambient air from the cabinet. The gap created between the barrier door and the access opening is thus part of the flow path of the ambient air being passed through the refrigerated cabinet to effect the necessary defrosting function. Temporary closing of the gap by customers is operatively provided for by the disclosed door operating mechanism.

The invention encompasses the use of such an air defrost means to selectively create a gap between the barrier door and the access opening of refrigerated display cabinets having only a single circulated, refrigerated air band propelled within an air conduit or having a plurality of circulated air bands therein of the type which are used in food outlets without heat transfer barrier doors. When a plurality of air bands are included in the cabinet one of these will function as a guard band and can be operated only when needed due to expected or actual use conditions in the store.

It is, therefore, an object of the present invention to provide an improved ambient air defrost means for a refrigerated display cabinet having a customer access opening therein covered by a movable door which provides for low energy consumption operation.

Another object of the present invention is to provide a refrigerated display cabinet having a door operating mechanism which selectively creates a gap between a barrier door and the access opening covered by the door in order to provide for ambient air passage through the cabinet for defrosting purposes.

Still another object of the present invention is to provide a door operating mechanism which accommodates closing of the gap by the application of outside force.

A still more specific object of the present invention is to provide a glass door merchandiser refrigerated display cabinet utilizing an improved ambient air defrost system wherein during the defrost operation ambient air is drawn into the cabinet and circulated through at least a substantial portion of the primary refrigerated air conduit and is thereafter expelled from the cabinet by utilizing an air flow path which passes through a gap created between the glass door and an access opening which is covered by the door.

Specific preferred embodiments of the invention will be described below with reference to the appended drawing figures;

DESCRIPTION OF THE PREFERRED EMBODIMENTS

Figure 1:
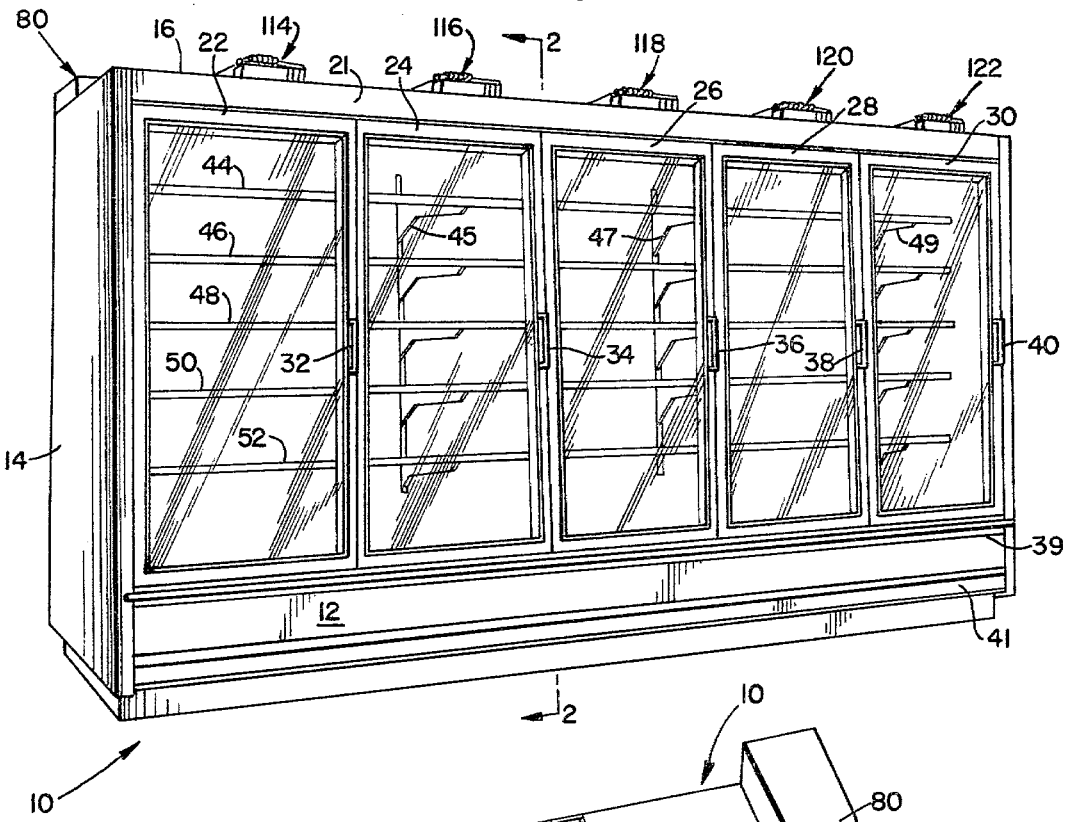
FIG. 1 is a perspective schematic view of a refrigerated display cabinet equipped with five door operating mechanisms of the present invention.
Figure 2:
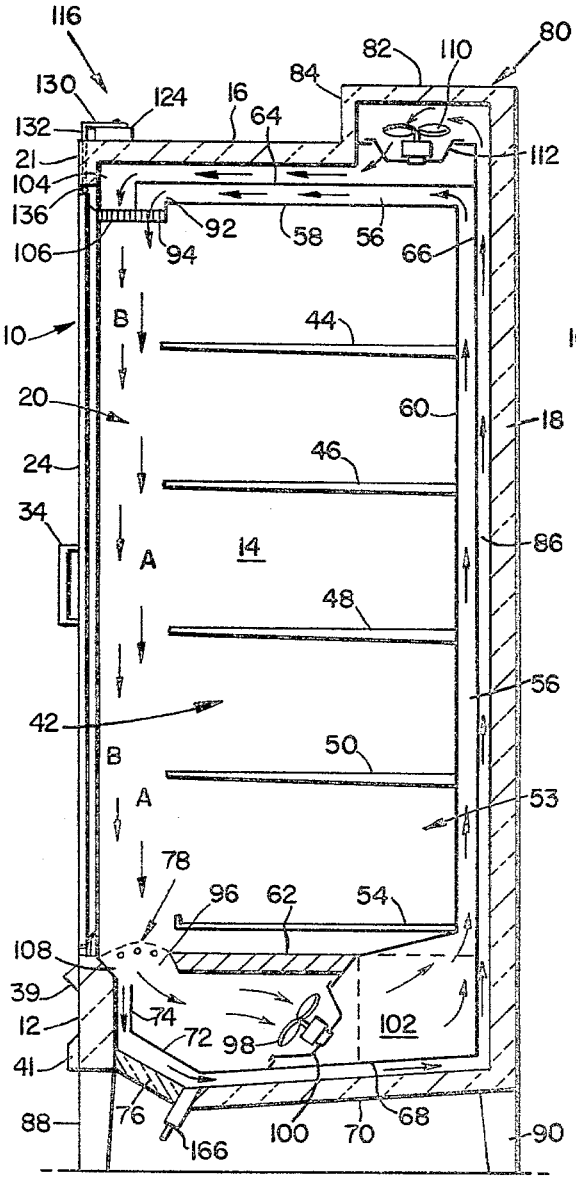
FIG. 2 is a cross-sectional elevation view of the refrigerated display cabinet shown in FIG. 1 taken on the line 2—2 and showing the cabinet in a refrigeration cycle of operation with two circulated air bands.
Figure 3:
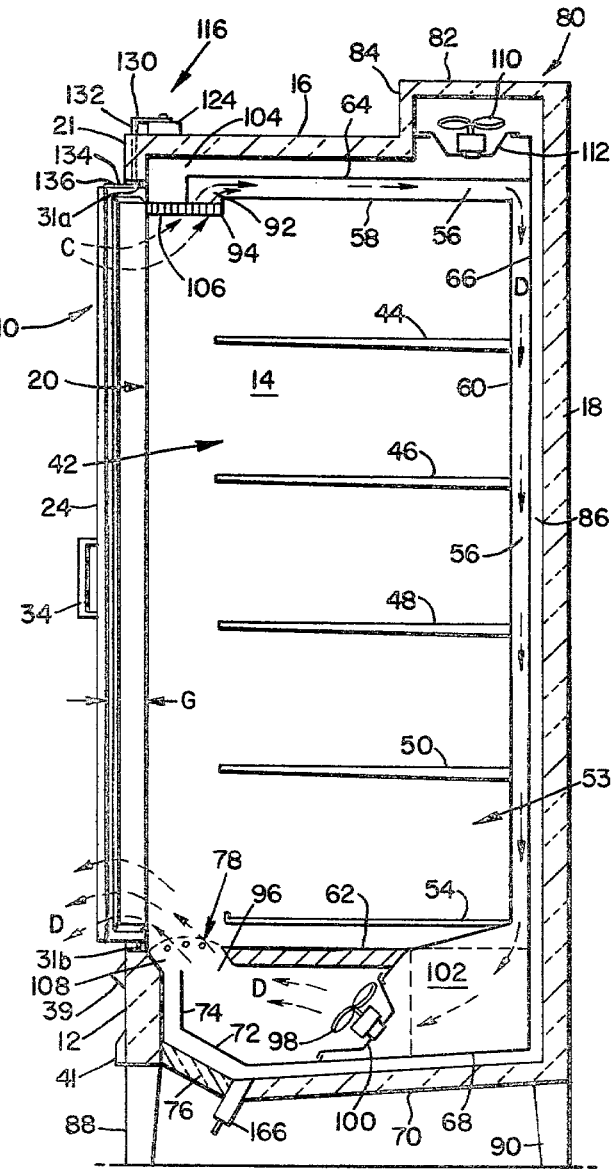
FIG. 3 is a cross-sectional elevation view of the display cabinet shown in FIG. 2 when in a defrost cycle of operation.

Referring to FIGS. 1–7, an upright refrigerated display cabinet or case assembly, generally indicated as 10, has an insulated front wall 12, side walls 14, top wall 16 and a rear wall 18, which are best shown in FIGS. 2 and 3. Display case 10 has an access opening 20 in its front wall 12 located below the top panel 21 which is covered by one or more barrier doors illustrated by five doors 22, 24, 26, 28 and 30. Each door is attached to the display cabinet by a pair of vertical hinge pins shown as 31*a* and 31*b* in FIG. 3 and each door has a handle shown as 32, 34, 36, 38 and 40 respectively. Upper and lower bumper guard rails 39 and 41 are also provided on front wall 12. Such a refrigerated display cabinet is typically referred to as a glass-door merchandiser even though transparent material such as plastic can be used in the doors. Merchandiser refrigerated display cabinets can be used for storing either fresh foods, such as dairy products, or frozen foods requiring lower temperatures.

The interior of the display cabinet shown in FIGS. 2 and 3 has display space 42 in which there are arranged a plurality of display shelves 44, 46, 48 and 50, although more than four such shelves can be employed as illustrated by shelf 52 in FIG. 1.

Each shelf can be suppored by a plurality of vertically adjustable support brackets 45, 47, and 49 as shown for shelf 44 in FIG. 1. The space at the bottom of the shelves can be used as a storage space 53 and can have a shelf 54 at the bottom thereof as shown in FIGS. 2 and 3. Access to the refrigerated products on the display shelves is provided to customers and employees upon the opening of one or more of the doors and reaching into the case through access opening 20.

Disposed about display space 42 in FIGS. 2 and 3 is a primary air conduit 56 which is formed on the interior side by top panel 58, rear panel 60, and bottom display panel 62 which also form the interior surfaces of display space 42. The primary air conduit 56 is formed on the exterior side by an upper divider panel 64 which is connected along the rear edge thereof to a vertical divider panel 66 which extends downwardly and parallel to rear panel 60. Both panels 64 and 66 are shown, constructed of sheet metal although laminates of metal, plastic, and insulation can be used. Vertical divider panel 66 is connected along the lower edge thereof to bottom separator panel 68 which extends above and is spaced away from bottom insulated panel 70. Bottom separator panel 68 is connected at the front edge thereof to an inclined front separator panel 72 which is, in turn, joined to a substantially vertical front divider panel 74. An inclined bottom member 76 is connected to the front edge of bottom panel 70 and is connected at its frontmost edge with the bottom of front wall 12 which extends upwardly and provides front support for an air grille 78 which then extends from the front wall 12 in an arcuate fashion into bottom storage space 53.

The bottom rear edge of bottom panel 70 is connected to rear wall 18. The top portion of rear wall 18 and part of top wall 16 incorporate a secondary air conduit fan housing 80 which is constructed of a top panel 82 connected along the top edge of rear wall 18 and along the front edge thereof to vertical exterior member 84 which is connected by the lower edge thereof to top wall 16. The outermost conduit formed between top wall 16 and upper divider panel 64 at the top of the cabinet extends vertically downward between divider panel 66 and rear wall 18 and acts as a secondary air conduit 86 which also extends between bottom separator panel 68 and bottom panel 70 in the lower portion of the cabinet. Support feet 88 and 90 are also provided for bottom wall 70.

The primary air conduit 56 terminates at its upper end in a primary conduit outlet opening 92 in which are arranged downwardly oriented directional louvers 94. An air inlet opening 96 is provided at the opposite end of primary air conduit 56 immediately below grille 78 and functions as an air intake for the primary air band indicated by arrows A. Outlet opening 92 and inlet opening 96 are thus arranged in aerodynamic alignment for the primary air band. The primary air band A is circulated by motor-driven primary fan 98 which is positioned in the bottom portion of primary conduit 56 and is supported therein by a baffle plate 100. Also positioned within conduit 56 are one or more evaporator coils of a refrigeration means indicated schematically as low temperature element 102. This refrigeration means consists of a sheet metal holder in which a plurality of refrigeration evaporation coils are arranged. The sheet metal sides have openings to allow for passage of one or more air bands as illustrated in FIGS. 2 and 3 by the air flow arrows and perforations. The primary air band propelled through conduit 56 by fan 98 is maintained in a refrigerated, low temperature condition during the refrigeration cycle of operation of cabinet 10.

The upper front portion of secondary air conduit 86 formed between upper separator panel 64 and top wall 16 terminates in a secondary air conduit outlet opening 104 in which are positioned downwardly oriented directional louvers 106 which function to direct the air flow downwardly across the inside of door 24 as shown by the secondary air guard band indicated by arrows B in FIG. 2. The secondary air band enters air grille 78 at the bottom portion of door 24 and then into a secondary conduit air inlet opening 108 which is positioned under air grille 78. The inlet and outlet openings of the secondary air conduit are also positioned in aerodynamic alignment. This secondary air inlet opening is separated from the primary conduit inlet opening 96 by the top front portion of front divider panel 74. During the refrigeration cycle of operation shown in FIG. 2 the secondary air band B is propelled downward through the outlet opening 104 and into inlet opening 108 and then between front separator panel 72 and inclined bottom member 76. Thereafter air band B is circulated between separator panel 68 and bottom panel 70 then upwardly in conduit 86 between vertical divider panel 66 and rear wall 18 by means of a motor-driven secondary conduit fan 110 mounted in baffle 112 positioned within fan housing 80 at the top of the case 10.

FIG. 1 shows door operating mechanisms 114, 116, 118, 120, and 122 affixed on top wall 16. The preferred embodiment is the provision of a single door operating mechanism, arranged to open each door separately. In the specific embodiment shown in FIGS. 1–7 mechanisms 114, 116, 118, 120, and 122 are electric motor and reduction gear box assemblies each of which operate a flexible lever system to open doors 22–30.

Figure 4:
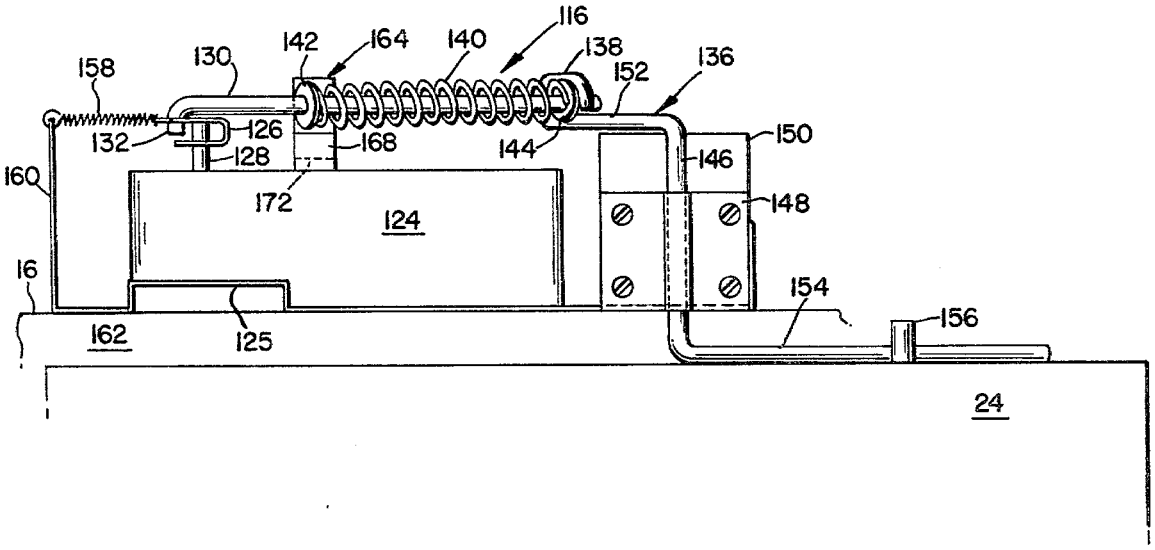
FIG. 4 is a close-up front elevation view of the door operating mechanism with a door shown in closed position.
Figure 6:
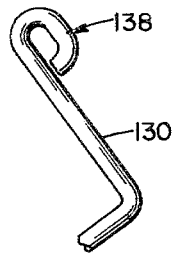
FIG. 6 is a preferred form of the end portion of the door opening device of the operating mechanism.

Door operating mechanism 116 is best shown in FIG. 4 wherein an electric motor and gear box assembly 124 is mounted on a base plate 125 on the front portion of top wall 16 and has a swing arm 126 crimp-attached to a square cross-section output shaft 128. Arm 126 is pivotally linked at its opposite end to power transmission rod 130 through interconnection of the downwardly formed end portion 132 with a hole 134 positioned in the terminal end of arm 126. The opposite end of power transmission rod 130 is supported by a door opening device 136 which has a rod cooperating end portion 138 designed for this purpose. In the preferred embodiment this end portion 138 is in a partially closed loop form as shown in FIG. 6.

A compression spring 140 is positioned in axial alignment about rod 130 between spring stop 142 and the door opening device end portion 138. If desired, a bearing washer 144 can be interposed between the spring 140 and the end portion 138. A retainer pin 145 holds rod 130 within end portion 139. Door opening device 136 is formed with a vertical shaft 146 which is rotatably supported by a bracket 148 secured to a vertical flange 150 which is, in turn, connected to base plate 125. A horizontal lever arm 152 connects the upper end of shaft 146 with the loop-shaped end portion 138. The bottom end of shaft 146 is connected to a horizontal door opening lever 154. The end portion of lever 154 bears against stud 56 which is formed on the upper edge portion of door 24. The relative angular positions of the lever arm 152 and the door opening lever 154 can be seen in FIG. 5.

A return tension spring 158 is connected between swing arm 124 and on upstanding flange 160 which is integrally connected to base plate 125.

Figure 7:
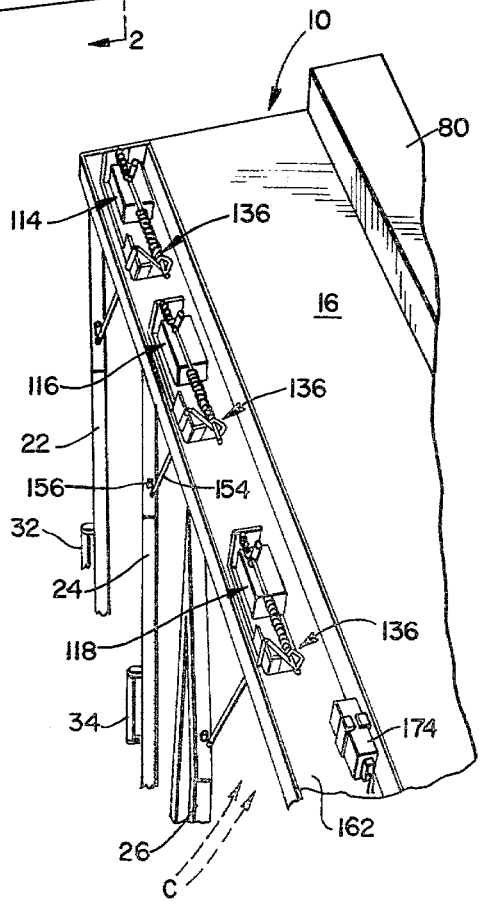
FIG. 7 is a perspective longitudinal schematic view of the display cabinet shown in FIG. 1 wherein three door operating mechanisms are shown for opening the associated doors.
Figure 5:
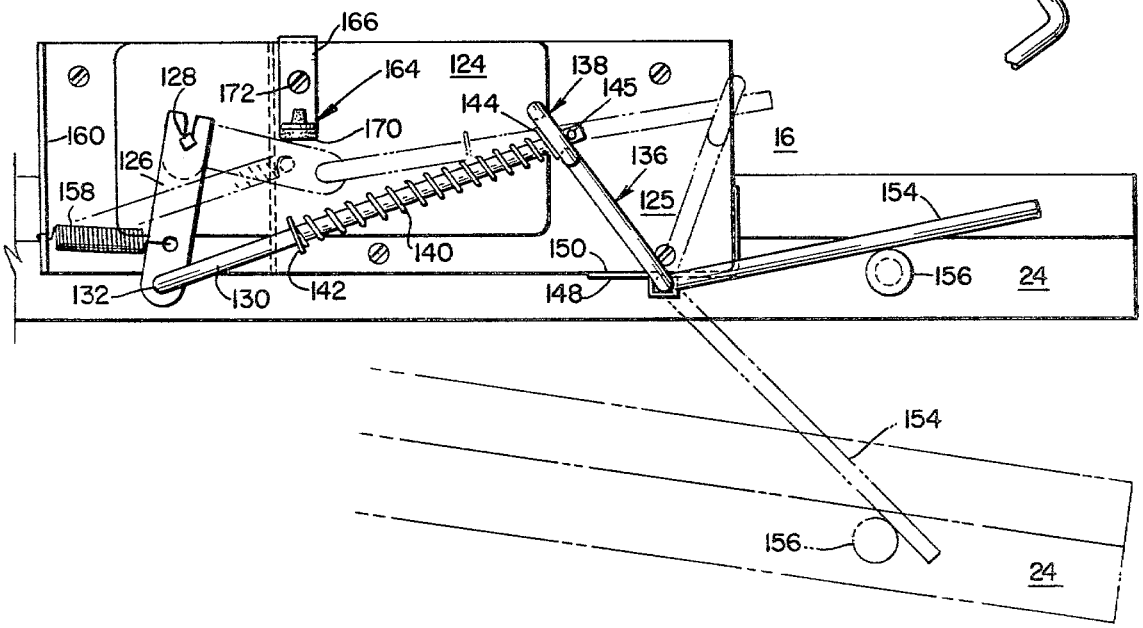
FIG. 5 is a top plan view of the door operating mechanism shown in FIG. 4.

The door operating mechanism 116 including its base plate 125 is designed to permit attachment to the front portion of top wall 16 in a position so that shaft 146 overhangs the front edge of door jamb 162 as shown in FIG. 7. FIG. 5 shows the mechanism 116 with the door jamb 162 removed. If desired the base plate 125 can be configured to fit the bottom of the motor and gear box assembly 124. A swing arm stop 164 is attached to the upper surface of the assembly 124 and is formed by a horizontal attachment member 166 and a stop arm 168 which has a rubber or elastomeric pad 170 attached to the front face thereof. A connector 172 is attached between member 166 and assembly 124.

A control means (not shown) for cabinet 10 is designed to power the door operating mechanisms when the doors 22, 24, 26, 28, and 30 are to be opened during the defrost cycle. The control means is also programmed to control the operation of the refrigeration cycle of the low temperature element 102 and the power delivered to fans 98 and 110 in order to conduct the defrost function.

When electrical current is delivered to door operating mechanism 116 the motor causes output shaft 128 to rotate and swing arm 126 to pivot about the axis of shaft 128. This, in turn, moves power transmission rod 130 toward the position shown by phantom lines in FIG. 5. The force from swing arm 126 is transmitted through compression spring 140 to the end portion 138 of door opening device 136. This causes door opening lever 154 to push outward against stud 156 to partially open door 24 in order to create gap G between the door and the cabinet door frame. The swing arm 126 comes to rest against stop member 164 when the gap is created and the gear assembly holds the swing arm 126 in a fixed position. The motor and gear box assembly is designed to permit return of the swing arm 126 to the original solid line position by force exerted through return tension spring 158 when the gear box hold is released. Thus, electrical current supplied to the motor and gear box assembly 124 causes power transmission rod 130 to exert motive force against door operating device 136 through compression spring 140 in order to open the door. When the electrical current is terminated a gear hold (not shown) is actuated within assembly 124. Another signal given upon completion of a defrost cycle causes the gear hold to release and the swing arm then returns to its original position under force exerted by tension spring 158.

In the event that a customer or employee attempts to close one or more doors during the defrost period when they are opened the door opening device 136 will tend to return to the solid line position shown in FIG. 5, but the swing arm 126 will remain in the phantom line position. This motion caused by the application of outside, external force is taken-up by the compression spring 140. Upon release of the outside force the door will again be partially opened by the compression spring force.

FIG. 6 shows a preferred form of the end portion loop 138 which permits the motion take-up movement in an efficient manner. The interior surface of the loop is elliptical in shape which provides for lateral movement of the rod 130 as the door opening device 136 is swung toward the swing arm 126 by application of outside force.

The compression of spring 140 by the application of outside force results in a flexing of the articulated connection between the power transmission rod 130 and the door opening lever arm 152. The motion take-up means described above for providing this flexing action through compression of spring 140 enables the movement of the doors to be accommodated without damage to the motor and gear box assembly 124.

A single door operating mechanism can be used for each door as illustrated by FIGS. 1–7. It is also possible to use a single motor and gear box assembly for powering several power transmission rods for opening a plurality of the doors simultaneously.

FIG. 7 shows three door operating mechanisms 114, 116, and 118 for opening doors 22, 24, and 26, respectively. The doors are shown in partially opened positions with the top panel 21 of front wall 12 removed. Due to the spacing of the motor and gear box assemblies along the space immediately over the door jamb 162 other equipment such as light ballasts 174 can also be positioned above the door jamb. As shown in FIG. 7 the door opening device vertical shafts can pass through the front edge of door jamb 162.

As a specific disclosure of engineering details for a 5-door, 12 feet cabinet, the motors in the assemblies 124 can be 9 watt Dayton damper motors operating from either 110–115 volts or 220–230 volts lines. These motors develop 15 pounds output force. Nine (9) pounds of force per door which has been found sufficient for creation of the gaps, G. The compression spring 140 can be of 12 pound force in order to transmit sufficient force to break the magnetic seals positioned about the doors or, if desired, up to about 20 pound springs can be used. The tension spring 158 can be of 5 to 6 pounds tensile force and desirably extends about one inch for the opening of the doors.

The door operating mechanisms 114–122 selectively create a gap, G, between the barrier doors 22–30 and the access opening 20. In the defrost cycle of operation of cabinet 10 ambient air is drawn into and/or expelled out of the cabinet 10 through the gap G.

A preferred mode of defrost operation of cabinet 10 is shown in FIG. 3 wherein door 24 has been opened by door operating mechanism 116 and ambient air (illustrated by dashed arrows C) is drawn through the upper portion of the gap G into the primary air conduit outlet opening 92 and into the primary air conduit 56 by means of the primary conduit fan 98 being operated in reverse direction from that shown in FIG. 2 for the refrigeration cycle of operation. The ambient air thus drawn into cabinet 10 is propelled through the primary conduit 56 as shown by the dashed arrows around the periphery of display space 42 downwardly in the rear portion of the primary conduit 56 and between bottom panel 62 and bottom separator panel 68 and then up to the front of the primary conduit 56. The primary air band with the entrained ambient air C is then caused to continue flowing upward and outward of cabinet 10 through the lower portion of gap G, created between door 24 and access opening 20. During this defrost cycle the warmer ambient air raises the temperature of the air flowing in the primary conduit and melts the frost and ice which has accumulated on low temperature element 102. The secondary conduit fan 110 is not operated during this preferred defrost cycle and hence secondary air flow is dormant.

The reversed air flow arrows have been labeled D in conduit 56 after contact with element 102 since the primary conduit air band is then a defrost ambient air band. If desired, the speed of the primary conduit fan 98 can be increased during this reverse flow and/or the pitch of the blades can be set to move a greater volume of air in the reverse, defrost direction than in the refrigeration cycle shown in FIG. 2 to provide quicker defrost. A 25% to 50% greater air flow during defrost can be achieved in this manner. The water created by this defrost action is then drained from the bottom of cabinet 10 by drain 166 which is arranged at the convergence of the downward sloping bottom panel 70 and inclined bottom member 76.

At the termination of the defrost cycle the control means operates door operating mechanism 116 to allow door 24 to close and for fan 98 to then reverse its direction to re-establish the primary, refrigerated air band A shown in FIG. 2. At the same time secondary fan 110 can be engaged for operation under one of the operating alternatives as described below.

A plurality of conduit fans illustrated by primary conduit fan 98 and the secondary conduit fan 110 shown in FIGS. 2 and 3 are spaced along the length of cabinet 10 shown in FIG. 1. For example, two each of these fans are normally provided for an eight foot long case or three each of the primary and secondary fans are provided for a twelve foot case. By way of example, but not limitation, the overall height of cabinet 10 is approximately 82 inches and the width is approximately 40 inches. Such cabinets are manufactured in lengths up to 12 feet.

MODES OF OPERATION

The operation of motor driven fans 98 and 110, refrigeration element 102, and door operating mechanism 116 is controlled by a control means which selectively operates these elements of cabinet 10 in a refrigeration cycle and then in an alternate defrost cycle. The control means receives signals from condition and time sensors and switches operation of cabinet 10 between the two cycles. The operation during the defrost cycle is controlled by an air defrost means which opens the doors and controls the air moving means, fans 98 and 110. At the termination of the defrost cycle, the air defrost means controls the door operating mechanisms such as 114, 116, 118, 120, and 122 to close the doors and the fans 98 and 110 to revert to the refrigeration operation. The control means then takes over operations and activates the refrigeration means 102. The control means can be fabricated from conventional components, although arrangement of these components can result in several degress of freedom in the operation of the cabinet. The control means can function during the refrigeration cycle as shown in FIG. 2 wherein air fans 98 and 110 are continuously operated and refrigerant is evaporated in low temperature element 102 as needed in order to maintain the low temperature required by products stored in display space 42. During the refrigeration cycle the doors are normally closed as shown in FIG. 2, but are partially opened by the door operating mechanisms during the defrost cycle.

An alternate mode of operation can be provided for fan 110 during the refrigeration cycle. Door switches can be provided for operation by any of the doors so that the secondary conduit fan 110 closest to the access opening covered by that door will be activated upon the opening of the door. For this purpose a switch can be installed within cabinet 10 to sense when the door is opened. Another variation is that the opening and closing of the doors by customers and employees can be used as numerical input to an electronic counting circuit so that the secondary fan 100 is operated whenever a particular frequency of openings per time period is exceed. In this manner cabinet 10 can be provided with a control means which is responsive to the shopping demand placed on the unit. This type of sensing means provides signals for the control means and can be provided for all barrier doors or for only spaced and selected doors. Such sensing switches can be set so that they do not sense the defrost cycle opening of the doors by the door operating mechanisms.

Yet another variation can be the operation of secondary fan 110 depending upon the temperature and humidity conditions in the ambient store air or in the cabinet display space.

The defrost cycle of operation for cabinet 10 can be initiated be sensing the temperature at locations spaced slightly away from the coils in low temperature element 102 so that the build-up of a predetermined thickness of frost and ice on the coils will activate the sensing element which can then initiate a defrost cycle. Another means is a timer which controls the defrost cycles initiations at set intervals. Other variations are to record store ambient conditions, particularly relative humidity, and to vary the time cycle of defrost depending on such conditions. The number of openings of the cabinet doors can also be included as a control feature as above described and referenced to the operation of the secondary conduit fan 110.

The following actions occur when a defrost cycle is initiated. The evaporation of refrigerant in low temperature element 102 is terminated; door operating mechanism 116 is operated to open the door 24 as illustrated in FIGS. 2–6; secondary conduit fan 110 is preferably stopped; and primary conduit fan 98 is reversed so that the air flow pattern is as shown in FIG. 3, whereby ambient air enters the top portion of the gap created between the barrier door 24 and the access opening 20 and then ambient air flows through primary conduit 56 in a reverse direction in order to contact the frost and ice coated coils in low temperature element 102 and thereafter the resultant defrost ambient air is expelled from the bottom portion of the gap as shown. The defrost cycle can continue until a preset time is exceeded or a temperature measurement can be taken in the close proximity of the coils in low temperature element 102 so that the defrost cycle is terminated when that sensed point in element 102 reaches a predetermined temperature, for example 50° F., for which purpose a sensor known as a Klixon can be employed.

The door operating mechanisms 114, 116, 118, 120, and 122 can be arranged to open the cabinet barrier doors 22, 24, 26, 28, and 30 with several degress of freedom: (1) all doors can be opened simultaneously as illustrated; (2) those doors having high customer usage can be opened more frequently for defrost since the closest evaporator coils cooling the primary air band will accumulate more ice; (3) individual doors or a selected sequence such as alternate doors in the plural series of barrier doors can be opened for the defrost cycle; (4) the doors can be opened by predetermined gap distances such as 1 to 7 inches by way of preferred example or by a variable gap distance depending on the defrost condition and ice accumulation which can be used to define the ambient air intake requirement; and (5) the defrost cycle initiation and gap creation by the air defrost means including the door operating mechanism can be controlled by the need for defrosting as determined by frost and ice buildup sensed on the low temperature element 102. For operations described by numbers 2 and 3, above separate operating mechanisms such as shown by FIGS. 4 and 5 are needed for each door.

ALTERNATIVE EMBODIMENTS

Figure 8:
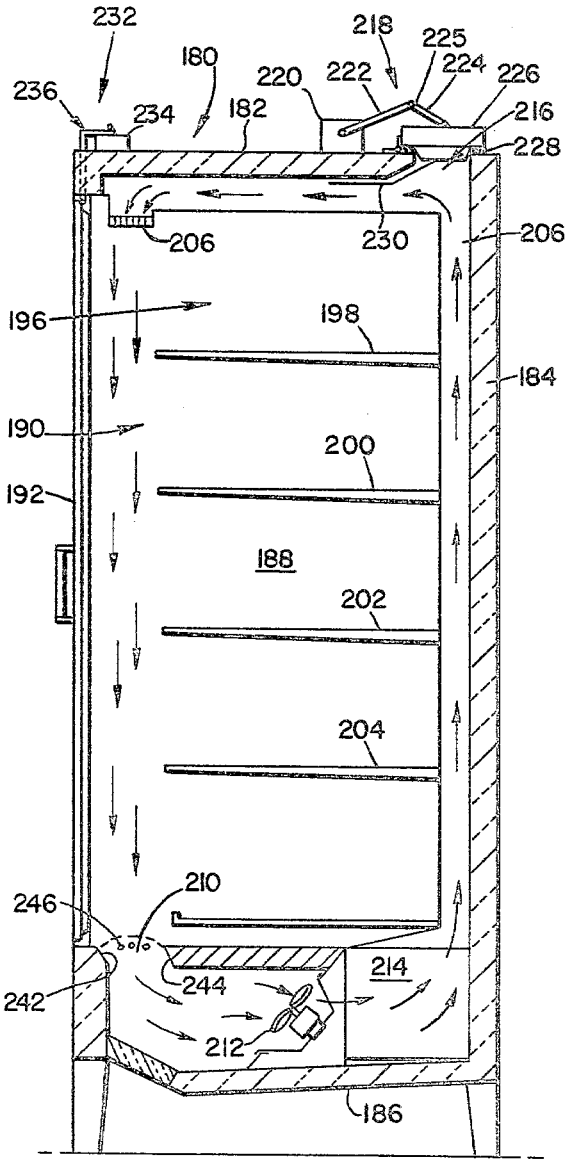
FIG. 8 is a schematic cross-sectional diagram of a second modification of a refrigerated display cabinet having a single circulated air band and shown in a refrigeration cycle of operation.
Figure 9:
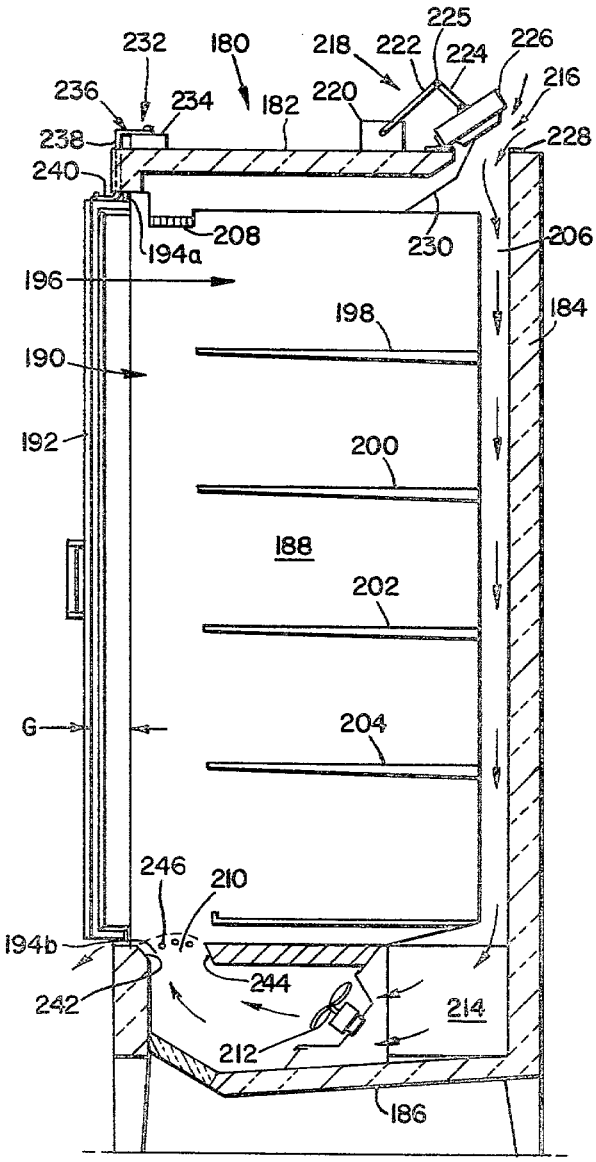
FIG. 9 is a cross-sectional diagram of the refrigerated display cabinet shown in FIG. 8 when in a defrost cycle of operation.

Referring to FIGS. 8 and 9, a refrigerated display case 180 has a top wall 182, a rear wall 184, a bottom wall 186 and two side walls 188. Display case 180 has an access opening 190 in its front which is covered by either a single or a plurality of glass doors 192. Each door is attached to the display case of a pair of hinge pins **194*a* and 194*b* located at the top and bottom of door 192 similarly to pins 31*a* and 31*b* in FIG. 3** above. These hinge pins can be spring biased for closing. Such a display case is typically referred to as a glass door merchandiser. A glass door merchandiser refrigerated display case can be used for storing either fresh foods, such as diary products, or frozen foods.

The interior of the display case has a display section 196 in which there are arranged a plurality of display shelves 198, 200, 202, and 204. Access to the refrigerated products on the display shelves is obtained by opening one of the doors 192 and reaching into the case through opening 190.

Surrounding display section 196 is a single air conduit 206. Air conduit 206 extends along top wall 182, rear wall 184 and bottom wall 186 of the display case. Conduit 206 has an outlet opening 208 arranged near the top of the display case and an inlet opening 210 arranged near the bottom of the display case. Outlet opening 208 and inlet opening 210 are arranged in aerodynamic alignment so that air expelled through opening 208 is directed along a substantially vertical path towards and into inlet opening 210 so as to form a vertically extending air curtain across opening 190 inside of glass door 192.

Arranged within air conduit 206 is at least one fan 212 and an evaporator coil 214, or a plurality of such evaporator coils. Both fan 212 and evaporator coil 214 are arranged in the bottom portion of the air conduit. Fan 212 is positioned upstream of evaporator coil 214 so that the fan creates a positive pressure air flow through the coils during the refrigeration cycle of operation. Such a positive pressure air flow provides for better and more efficient air circulation than if the fan was located downstream of the coil, where it would rely on a suction or drawing action of the air through the coil.

During a refrigeration cycle of operation of display case 180, air is circulated by fan 212 through air conduit 206 so as to pass through evaporator coil 214. As the air passes through evaporator coil 214 it is refrigerated. Such refrigerated air is then expelled out of conduit 206 through outlet opening 208 along a path across opening 190 and back into inlet opening 210, where such air is then recirculated and again refrigerated.

It is intended that the display case of the present invention, such as represented by the exemplary embodiment illustrated in the drawings, employ ambient air for purposes of defrosting both the interior of air conduit 206 and evaporator coil 214. Inasmuch as the front of the display case is covered by glass door 192, a mechanism must be provided for enabling ambient air from outside of the display case to be drawn into the case and passed through the conduit without such air entering display section 196.

In order to enable ambient air to be drawn into the air conduit during a defrost cycle of operation, the display case can be provided with an aperture in top wall 182. During the refrigeration cycle of operation, aperture 216 is closed by an appropriate closure member which will be described below. In addition, door 192 is opened during the defrost cycle of operation for enabling the ambient air that has passed through the conduit to be expelled from the display case.

First, considering aperture 216 in top wall 182 of the display case, this aperture is closed by top gate mechanism 218 during the refrigeration cycle of operation. Gate mechanism 218 includes a motor 220, a first arm 222 and a second arm 224 attached by pivot pin 225. At the end of arm 224 a closure member 226 is pivotally affixed. The gate mechanism in its normal position has arms 222 and 224 arranged so that closure member 226 is inserted into aperture 216 and sits against seat 228 in the top of the display case. Attached to closure member 226 is a blocking member 230. During the refrigeration cycle of operation, blocking member 230 allows air to pass through the upper portion of the air conduit so as to be expelled through outlet opening 208. The positions of the gate mechanism and the associated elements during a refrigeration cycle of operation are shown in FIG. 8.

During the defrost cycle of operation shown in FIG. 9, motor 220 pivots arms 222 and 224 so as to lift closure member 226 up and away from aperture 216, thereby allowing air to be drawn into conduit 206 through aperture 216 when the air flow direction is reversed. Simultaneously with the upward movement of closure member 226, blocking member 230 is pivoted into a position for substantially blocking the air flow through the conduit so as to prevent air from the display section from being drawn into air conduit 206 and on through outlet opening 208. Thus, the ambient air which is drawn into conduit 206 is prevented from being expelled through outlet opening 208 into display section 196 of display case 180.

In order to open the door during the defrost cycle, a door operating mechanism 232 can be arranged on the top of the display case. Motor 234 is coupled to transmission linkage 236 for pushing open door 192. Each door of a multiple set can be pivoted about its hinges when the associated door operating mechanisms are activated so as to slightly open doors by a distance G of approximately 1 to 7 inches along the free vertical edge of the door. The vertical rotatable rod 238 and the door opening lever 240 can be seen in FIG. 9.

The open door enables the ambient air emitted from air conduit 206 through opening 210 during the defrost cycle to be expelled from display case 180. To assist in the expulsion of the air through the open door, walls 242 and 244 of conduit 194 can be slanted outwardly, such as shown in FIGS. 8 and 9. This formation of walls 242 and 244 helps to direct the ambient air leaving opening 210 in a direction out of the open door and away from the display case.

Thus, during a defrost cycle of operation of the display case, closure member 226 is pivoted out of its aperture 216 and door 192 is opened. The operation of fan 212 is reversed so that air flows through air conduit 206 in a direction opposite the air flow during a refrigeration cycle. With this reverse flow of air, ambient air from outside of the display is drawn in through aperture 216 into conduit 206. The ambient air flows along the portion of the conduit adjacent to the rear wall of display case 180. Such ambient air then flows through evaporator coil 214 and out of the open doors. The ambient air serves to defrost both the interior of conduit 206 and evaporator coil 214. The air flow paths during the refrigeration cycle and defrost cycles of operation are shown by the arrows in FIGS. 8 and 9.

During the refrigeration cycle of operation, it is possible for condensation to accumulate on the grille work at the inlet opening. Such condensation can eventually lead to a buildup of frost, thereby blocking the openings in the grille work. In order to minimize such a condition, liquid lines 246 can be provided adjacent each of the openings of the grille work at inlet opening 210. Such liquid lines contain liquid refrigerant which is in the process of being carried towards the evaporator coil. Since such liquid refrigerant is warmer than the air passing through inlet opening 210, the liquid refrigerant serves to eliminate the buildup of condensation and frost on the grille covering the inlet opening.

In an alternative embodiment of the present invention, in refrigerated display cases, ambient air is drawn into air conduit 206 through the gap G created by open door 192 instead of an aperature top wall 182. The air flow during the refrigeration cycle of operation of such display cases is the same as FIG. 8. During the defrost cycle of operation of display case 180, ambient air is drawn passed the top portion of open door 192 into air conduit 206 through air outlet opening 208. The ambient air then is circulated through the air conduit and leaves the conduit through air inlet opening 210. After the ambient air leaves air conduit 206 it is expelled from the display case through the gap created by the partially opened door.

Other alternative embodiments of the refrigerated merchandiser display cabinets which can be defrosted by use of the door operating mechanism of the present invention are disclosed in the copending above-referenced application Ser. No. 141,360 filed Apr. 18. 1980 by Fayez F. Ibrahim. Also, the door operating mechanism can be used with retrofitted door assemblies for a wide range of types of display cabinets such as disclosed in the copending application Ser. No. 141,359 also filed Apr. 18. 1980. The control means for operating the refrigeration and defrost cycles in cabinets 10 and 180 of the present invention is identical with those disclosed in these two copending applications which have been incorporated herein by reference.

The door operating mechanism of the present invention comprises one or more motive means shown as motor and gear box assemblies, a flexible motion take-up means for independent operation for each door, and door opening means for each barrier door. If desired, the flexible motion take-up means providing for separate closing of the doors by outside forces can be integrally formed in the door opening means such as by forming properly sized springs in the force transmitting parts of the operating lever arms. This embodiment eliminates the need for the separate compression spring 140.

The door operating mechanism described herein is distinguished from the mechanism disclosed and claimed in U.S. Ser. No. 145,711 filed May 1, 1980 by Fayez F. Ibrahim in that the mechanism described in that earlier application utilized a tension spring and an operator rod which connects between separate mechanisms. The reduced number of parts which must be installed on the production line and the lack of interconnection between the individual door operating mechanisms result in the mechanism disclosed and claimed herein being more efficiently installed. The compression spring 140 also allows for a smoother automatic opening and return action after the outside force to close the doors is removed.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A display cabinet having refrigeration means and a display space therein, an opening in at least one wall of said cabinet for communicating ambient outside air with the air in said cabinet, said opening comprising an access opening for permitting products to be moved into and out of said display space, air moving means for circulating at least one air band within said cabinet and into contact with said refrigeration means during a refrigeration cycle, covering means for said opening including a barrier door for substantially covering said opening, and said refrigeration means comprising a low temperature element; comprising:

air defrost means including a door operating mechanism for selectively creating a gap between said barrier door and said access opening; said door operating mechanism comprising a motive means and an operably connected flexing means for enabling repeated closure of said door by an outside force independently of the functioning of said door operating mechanism, said air defrost means causing said air moving means to pass ambient air through said cabinet and through the gap between said barrier door and said access opening during a defrost cycle to bring the ambient air into contact with said low temperature element to remove frost therefrom and to thereafter eject the defrost ambient air from said cabinet; and, control means for selectively operating said air defrost means and said refrigeration means to defrost said low temperature element during a defrost cycle into refrigerate said cabinet during a refrigeration cycle.

2. The display cabinet according to claim 1, wherein said door operating mechanism includes a motion take-up means for enabling closure of said door by exertion of outside force independently of operation of said motive means.

3. The display cabinet according to claim 2, wherein said motion take-up means comprises a compressive spring action between said door and said motive means.

4. The display cabinet according to claim 1, wherein said door operating mechanism includes a power transmission means operably connected to said motive means and a door operating means connected to said power transmission means, said motive means operable to transmit force to said door opening means through said power transmission means for enabling the opening of said door, a motion take-up means incorporated in said door opening mechanism for enabling closure of said door by an outside force, and said flexing means enabling a closing movement of said door relative to said display cabinet independently of the operation of said motive means and for enabling transmission of a flexing force to said motive means.

5. The display cabinet according to claim 4, wherein said flexing means comprises a compression spring positioned to act between said power transmission means and said door opening means.

6. The display cabinet according to claim 5, wherein said power transmission means comprises a push rod pivotally connected to said motive means, and wherein said compression spring is positioned parallel to the axis of said push rod.

7. The display cabinet according to claim 6, wherein said power transmission means comprises at least one push rod pivotally connected to said motive means, and wherein said door opening means is pivotally secure to said display cabinet and comprises a spring engaging portion for cooperation with said push rod and said compression spring.

8. The display cabinet according to claim 7, wherein said compression spring is coaxially disposed about and aligned with said push rod and abuts said spring engaging portion of said door opening means by one end thereof, and wherein a spring stop is attached to said push rod to provide an abutment for the opposite end of said compression spring.

9. The display cabinet according to claims 7 or 8, wherein said power transmission means comprises a plurality of push rods pivotally connected to said motive means and a plurality of compression spring coaxially aligned with said push rods for taking up compressive force exerted on any of a plurality of doors.

10. A method for operating a refrigerated display cabinet having refrigeration means and a display space therein, and having an opening in at least one wall of the cabinet for communicating ambient outside air with the air in the cabinet, the opening comprising an access opening for permitting products to be moved into and out of said display space, air moving means for circulating at least one air band within the cabinet and into contact with the refrigeration means during a refrigeration cycle, covering means for the opening including a barrier door for substantially covering the access opening, and the refrigeration means comprising a low temperature element; the method comprising the steps of:

selectively operating the display cabinet and a refrigeration cycle of operation and in a defrost cycle of operation; during a refrigeration cycle, circulating the air band through the cabinet and into contact with the low temperature element; during a defrost cycle of operation, terminating operation of the refrigeration means, causing ambient air to be drawn into the cabinet and across the low temperature element, causing the defrost ambient air to be ejected from the cabinet, creating a gap between the barrier door and the access opening to enable ambient air through-flow and providing for closing of the gap between the barrier door and the access opening by exertion of an outside force by the take-up of motion in a flexing means and re-establishment of the gap when the force is removed; the closing of the gap transmitting the exerted outside force to the cabinet; whereby ambient air is drawn into the air band and across the low temperature element to defrost the same by communicating ambient air with the air band in the display cabinet.

11. A method according to claim 10, wherein said step of creating a gap between the barrier door and the access opening is accomplished by transmission of force from a motive means through a power transmission means having a motion take-up means integrally formed therein, and wherein the motion take-up means and the flexing means enable closing of the gap by the exerted outside force.

12. A method according to claim 11, wherein a plurality of barrier doors are provided for covering the access opening, and wherein said step of creating gaps between the barrier door and the access opening is accomplished by means of force transmitted from a motive means through a power transmission means including a motion take-up means separably operative for each of the plurality of doors, and wherein the take-up means functions independently for each of the plurality of doors to accommodate closing of the gap for each of the doors independently by an outside force and wherein said take-up provides for re-establishment of each gap between the independent force is removed therefrom.

13. The method according to claim 10, wherein a single barrier door is provided for covering the access opening, and wherein the step of creating a gap between the barrier door and the access opening is accomplished by means of force transmitted from a single motive means through a power transmission means which is operative solely for the door.

14. A door operating mechanism for use with a refrigerated display cabinet having an access opening and at least one openable door for covering said access opening and for enabling communication of the outside atmosphere with the inside of said display cabinet; comprising a motive means and a flexing means operably connected thereto for enabling repeated closures of said door by an outside force independently of the force output from said door operating mechanism and enabling return of said door to the opened position when the outside force is removed, said flexing means enabling transmission of a flexing force to said motive means, said door operating mechanism enabling the selective formation of a gap between said door and said access opening, and said door operating mechanism activatable in response to the defrost requirements of said display cabinet wherein ambient air is movable through the gap created between said door and said access opening during a defrost cycle of operation of said cabinet.

15. In a refrigerated display cabinet having at least one openable door for enabling access to and the communication of the outside atmosphere with the inside of the display cabinet, and air moving means for circulating at least one air band within said cabinet and into contact with said refrigeration means during a refrigeration cycle, the improvement comprising:

air defrost means including a door operating mechanism for selectively creating a gap between said barrier door and said access opening; said door opening mechanism including a motive means, a power transmission means operably connected to said motive means, and a door opening means connected to said power transmission means, said motive means operable to transmit force to said door opening means through said power transmission means for enabling the opening of said door, a motion take-up means incorporated in said door opening mechanism for enabling closure of said door by an outside force, a flexing means included in said motion take-up means for enabling a closing movement of said door relative to said cabinet independently of the operation of said motive means and for enabling transmission of a flexing force to said motive means, and said air defrost means causing said air moving means to pass ambient air through said cabinet and through the gap between said barrier door and said access opening during a defrost cycle to bring the ambient air into contact with said low temperature element to remove frost therefrom and to thereafter eject the defrost ambient air from said cabinet.

16. The improvement according to claim 15, wherein said flexing means enables the take-up of compressive force exerted between said door and said motive means.

17. The improvement according to claim 15, wherein a single barrier door is provided for covering the access opening, and wherein the step of creating a gap between the barrier door and the access opening is accomplished by means of force transmitted from a single motive means through a power transmission means which is operative solely for the door.

18. The improvement according to claim 17, wherein said power transmission means comprises a push rod pivotally connected to said motive means, and wherein said compression spring is positioned parallel to the axis of said push rod.

19. The improvement according to claim 17, wherein said power transmission means comprises at least one push rod pivotally connected to said motive means, and wherein said door opening means is pivotally secured to said cabinet and comprises a spring engaging portion for cooperation with said push rod and said compression spring.

20. The improvement according to claim 19, wherein said compression spring is coaxially disposed about and aligned with said push rod and abuts said spring engaging portion of said door opening means by one end thereof, and wherein a spring stop is attached to said push rod to provide an abutment for the opposite end of said compression spring.

21. The improvement according to claim 17, wherein said motive means transmits force through said compression spring to said door opening means to enable opening of said door, and wherein said compression spring takes up externally applied compressive force exerted to close said door when it is an opened position without change in the position of said motive means.

22. The improvement according to claim 15, wherein said power transmission means comprises a plurality of push rods pivotally connected to said motive means and a plurality of compression springs coaxially aligned with said push rods for taking up compressive force exerted on any one of a plurality of doors.

23. The improvement according to claim 15, wherein said flexing means enables the return of said door opening means to the opened position when the outside force is removed.

24. The improvement according to claim 17, wherein said door opening means is movable to partially open said door through force extended by said motive means through said power transmission means and said compression spring; and wherein said door opening means is movable in an opposite direction to permit closing of said door independently of the functioning of said motive means by exertion of a closing force against said door.

25. The improvement according to claim 24, wherein said display cabinet is provided with multiple doors and wherein a plurality of power transmission means are operably connected to said motive means, and wherein a plurality of separate door opening means are included for selectively opening one or more of said multiple doors independently.

* * * * *

UNITED STATES PATENT AND TRADEMARK OFFICE

CERTIFICATE OF CORRECTION

PATENT NO. : 4,367,632

DATED : January 11, 1983

INVENTOR(S) : Ibrahim et al

It is certified that error appears in the above-identified patent and that said Letters Patent is hereby corrected as shown below:

Column 1, In the title of patent, change "merchandizer" to -- merchandiser --.

*Column 2, line 65, change "merchandiser refrigerated" to -- refrigerated merchandiser--.

*Column 4, line 25, change "merchandiser refrigerated" to -- refrigerated merchandiser --.

*Column 4, line 37, change "figures;" to -- figures. --.

*Column 5, line 19, change "Merchandiser refrigerated" to -- Refrigerated marchandiser --.

Column 5, line 27, change "suppored" to -- supported --.

Column 7, line 21, change "56" to -- 156 --.

UNITED STATES PATENT AND TRADEMARK OFFICE

CERTIFICATE OF CORRECTION

PATENT NO. : 4,367,632

DATED : January 11, 1983

INVENTOR(S) : Ibrahim et al

It is certified that error appears in the above-identified patent and that said Letters Patent is hereby corrected as shown below:

*Column 10, line 7, change "degress" to -- degrees --.

*Column 10, line 29, change "exceed" to -- exceeded --.

*Column 10, line 42, change "be" to -- by --.

*Column 11, line lo, change "degress" to -- degrees --.

*Column 11, line 45, change "diary" to -- dairy --.

*Column 15, lines 1 and 2, change "refrigerate" to -- refrigerated --.

*Column 18, line 20 change "an" to -- in --.

Signed and Sealed this

Thirty-first Day of August, 1993

Bruce Lehman

*Attest:*

BRUCE LEHMAN

*Attesting Officer*

*Commissioner of Patents and Trademarks*